US010500889B2

(12) United States Patent
Li et al.

(10) Patent No.: US 10,500,889 B2
(45) Date of Patent: Dec. 10, 2019

(54) BELT-DRIVEN PROCESSES FOR PRODUCING OPTICAL EFFECT LAYERS

(71) Applicant: SICPA HOLDING SA, Prilly (CH)

(72) Inventors: Xiang Li, Beijing (CN); Mathieu Schmid, Lausanne (CH); Claude-Alain Despland, Prilly (CH); Pierre Degott, Crissier (CH)

(73) Assignee: SICPA HOLDING SA, Prilly (CH)

( * ) Notice: Subject to any disclaimer, the term of this patent is extended or adjusted under 35 U.S.C. 154(b) by 10 days.

(21) Appl. No.: 15/500,410

(22) PCT Filed: Jul. 20, 2015

(86) PCT No.: PCT/EP2015/066526
§ 371 (c)(1),
(2) Date: Jan. 30, 2017

(87) PCT Pub. No.: WO2016/016028
PCT Pub. Date: Feb. 4, 2016

(65) Prior Publication Data

US 2017/0210160 A1 Jul. 27, 2017

(30) Foreign Application Priority Data

Jul. 30, 2014 (EP) ..... 14179119

(51) Int. Cl.
*B42D 25/369* (2014.01)
*B42D 25/364* (2014.01)
(Continued)

(52) U.S. Cl.
CPC ..... *B42D 25/369* (2014.10); *B41M 3/14* (2013.01); *B42D 25/364* (2014.10); *B42D 25/405* (2014.10)

(58) Field of Classification Search
CPC .. B42D 25/369; B42D 25/364; B42D 25/405; B41M 3/14
(Continued)

(56) References Cited

U.S. PATENT DOCUMENTS 2,418,479 A 4/1947 Pratt et al.
2,570,856 A 10/1951 Pratt et al.
(Continued)

FOREIGN PATENT DOCUMENTS

CA 2161816 5/1996
CN 102616042 8/2012
(Continued)

OTHER PUBLICATIONS

Chemistry & Technology of UV & EB Formulation for Coatings Inks & Paints vol. IV; Formulation by C. Lowe G. Webster S. Kessel and I. McDonald 1996 by John Wiley & Sons in association with SITA Technology Limited.
(Continued)

*Primary Examiner* — Justin V Lewis
(74) *Attorney, Agent, or Firm* — Muncy, Geissler, Olds & Lowe, P.C.

(57) ABSTRACT

The present invention relates to the field of the protection of value documents and value commercial goods. In particular, the invention relates to printing devices and processes for producing optical effect layers (OEL) comprising magnetically oriented magnetic or magnetizable pigment particles. In particular, the present invention provides processes for producing said OELs as anti-counterfeit means on security documents or security articles or for decorative purposes. The printing devices comprise a) an orienting device comprising an orientation means, said orientation means being either a magnetic field generating belt or a non-magnetic belt
(Continued)

comprising magnetic field generating elements, said belt being driven by at least two rollers, and b) a hardening unit.

16 Claims, 1 Drawing Sheet

(51) Int. Cl.
*B42D 25/405* (2014.01)
*B41M 3/14* (2006.01)

(58) Field of Classification Search
USPC ..... 283/67, 70, 72, 74, 82, 94, 98, 99, 901
See application file for complete search history.

(56) References Cited

U.S. PATENT DOCUMENTS

| | | | | |
|---|---|---|---|---|
| 3,676,273 | A | 7/1972 | Graves | |
| 3,791,864 | A | 2/1974 | Steingroever | |
| 4,838,648 | A | 6/1989 | Phillips et al. | |
| 5,364,689 | A | 11/1994 | Kashiwagi et al. | |
| 5,601,931 | A * | 2/1997 | Hoshino | G06K 19/06196 235/493 |
| 5,630,877 | A | 5/1997 | Kashiwagi et al. | |
| 6,103,361 | A | 8/2000 | Batzar et al. | |
| 6,410,130 | B1 | 6/2002 | Schuhmacher et al. | |
| 6,531,221 | B1 | 3/2003 | Schuhmacher et al. | |
| 6,582,781 | B1 | 6/2003 | Schuhmacher et al. | |
| 6,759,097 | B2 | 7/2004 | Phillips et al. | |
| 6,838,166 | B2 | 1/2005 | Phillips et al. | |
| 8,025,952 | B2 | 9/2011 | Raksha et al. | |
| 8,343,615 | B2 | 1/2013 | Raksha et al. | |
| 2002/0160194 | A1 | 10/2002 | Phillips et al. | |
| 2004/0009308 | A1 | 1/2004 | Schlaf et al. | |
| 2004/0051297 | A1 | 3/2004 | Raksha et al. | |
| 2005/0000585 | A1 | 1/2005 | Betley et al. | |
| 2010/0021658 | A1* | 1/2010 | Raksha | B05D 3/207 427/598 |
| 2013/0084411 | A1 | 4/2013 | Raksha et al. | |
| 2015/0079305 | A1* | 3/2015 | Wang | B41C 1/1058 427/547 |
| 2015/0352883 | A1* | 12/2015 | Schmid | B05D 3/20 283/73 |

FOREIGN PATENT DOCUMENTS

| | | | | |
|---|---|---|---|---|
| DE | 2006848 | | 9/1971 | |
| EP | 0406667 | | 1/1995 | |
| EP | 0710508 | | 5/1996 | |
| EP | 0686675 | | 2/1998 | |
| EP | 1666546 | | 6/2006 | |
| EP | 1710756 | | 10/2006 | |
| EP | 1810756 | | 7/2007 | |
| EP | 1819525 | | 3/2010 | |
| EP | 2165774 | | 3/2010 | |
| EP | 2263806 | | 12/2010 | |
| EP | 2263807 | | 12/2010 | |
| EP | 2306222 | | 4/2011 | |
| EP | 2325677 | | 5/2011 | |
| EP | 2402401 | | 1/2012 | |
| EP | 1878773 | | 8/2012 | |
| EP | 1674282 | | 6/2013 | |
| JP | 61110342 | | 5/1986 | |
| JP | 01169725 | | 7/1989 | |
| WO | 2002073250 | | 9/2002 | |
| WO | 2002090002 | | 11/2002 | |
| WO | 2003000801 | | 1/2003 | |
| WO | 2004007095 | | 1/2004 | |
| WO | 2005000585 | | 1/2005 | |
| WO | 2005002866 | | 1/2005 | |
| WO | 2006061301 | | 6/2006 | |
| WO | 2006063926 | | 6/2006 | |
| WO | 2007131833 | | 11/2007 | |
| WO | 2010058026 | | 5/2010 | |
| WO | 2010066838 | | 6/2010 | |
| WO | 2011092502 | | 8/2011 | |
| WO | 2011107527 | | 9/2011 | |
| WO | 2012038531 | | 3/2012 | |
| WO | 2012104098 | | 8/2012 | |
| WO | WO-2013152696 | A1 * | 10/2013 | B41C 1/1058 |
| WO | 2014108303 | | 7/2014 | |
| WO | WO-2014108303 | A1 * | 7/2014 | B05D 3/20 |

OTHER PUBLICATIONS

The Printing ink manual R.H. Leach and R.J. Pierce Springer Edition 5th Edition pp. 58-62.
Printing Technology J.M. Adams and P.A. Dolin Delmar Thomson Learning 5th Edition pp. 293-328.
"Handbook of print media" Helmut Kipphan Springer Edition p. 48.
The Printing ink manual R.H. Leach and R.J. Pierce Springer Edition 5th Edition pp. 42-51.
Printing Technology J. M. Adams and P.A. Dolin Delmar Thomson Learning 5th Edition pp. 359-360.
The Printing ink manual R.H. Leach and R.J. Pierce Springer Edition 5th Edition pp. 33-42.
The Printing ink manual R.H. Leach and R.J. Pierce Springer Edition 5th Edition p. 74.
Optical Document Security R. L. van Renesse 2005 3rd Edition pp. 115-117.
International Search Report and Written Opinion issued with respect to application No. PCT/EP2015/066526.
Japanese Office Action in counterpart Japanese Application No. 2017-504348 dated Nov. 13, 2018 (and English language translation of the Office Action).

* cited by examiner

BELT-DRIVEN PROCESSES FOR PRODUCING OPTICAL EFFECT LAYERS

FIELD OF THE INVENTION

The present invention relates to the field of printing devices and processes for producing optical effect layers (OEL) comprising magnetically oriented magnetic or magnetizable pigment particles. In particular, the present invention provides processes for producing said OELs as anti-counterfeit means on security documents or security articles or for decorative purposes.

BACKGROUND OF THE INVENTION

It is known in the art to use inks or compositions, comprising magnetic orientable magnetic or magnetizable pigment particles, particularly also optically variable magnetic or magnetizable pigment particles, for the production of security elements, e.g. in the field of security documents. Coatings or layers comprising oriented magnetic or magnetizable pigment particles are disclosed for example in U.S. Pat. Nos. 2,570,856; 3,676,273; 3,791,864; 5,630,877 and 5,364,689. Coatings or layers comprising oriented magnetic color-shifting pigment particles, resulting in particularly appealing optical effects, useful for the protection of security documents, have been disclosed in WO 2002/090002 A2 and WO 2005/002866 A1.

Security features, e.g. for security documents, can generally be classified into "covert" security features one the one hand, and "overt" security features on the other hand. The protection provided by covert security features relies on the concept that such features are difficult to detect, typically requiring specialized equipment and knowledge for detection, whereas "overt" security features rely on the concept of being easily detectable with the unaided human senses, e.g. such features may be visible and/or detectable via the tactile senses while still being difficult to produce and/or to copy. However, the effectiveness of overt security features depends to a great extent on their easy recognition as a security feature, because most users, and particularly those having no prior knowledge of the security features of a therewith secured document or item, will only then actually perform a security check based on said security feature if they have actual knowledge of their existence and nature.

Magnetic or magnetizable pigment particles in printing inks or coatings allow for the production of magnetically induced images, designs and/or patterns through the application of a corresponding magnetic field, causing a local orientation of the magnetic or magnetizable pigment particles in the coating, followed by hardening the latter. The result is a fixed magnetically induced image, design or pattern. Materials and technology for the orientation of magnetic or magnetizable pigment particles in coating compositions have been disclosed in U.S. Pat. Nos. 2,418,479; 2,570,856; 3,791,864, DE 2006848-A, U.S. Pat. Nos. 3,676,273, 5,364,689, 6,103,361, EP 0 406 667 B1; US 2002/0160194; US 2004/70062297; US 2004/0009308; EP 0 710 508 A1; WO 2002/09002 A2; WO 2003/000801 A2; WO 2005/002866 A1; WO 2006/061301 A1; these documents are incorporated herein by reference. In such a way, magnetically induced patterns which are highly resistant to counterfeit can be produced. The security element in question can only be produced by having access to both, the source of the magnetic or magnetizable pigment particles or the corresponding ink, and the particular technology employed to print said ink and to orient said pigment in the printed ink.

WO 2005/000585 A1 discloses printing machines comprising magnetic elements for orienting magnetic or magnetizable pigment particles. The disclosed magnetic elements are comprised in the impression cylinder. Alternatively, US 2005/000585 A1 discloses a stand-alone rotary magnetic orienting device, which can be used subsequent to a printing process, e.g. as an additional process station following in order to impose a particular orientation to magnetic or magnetizable pigment particles comprised in a freshly printed ink, prior to hardening (drying, curing) said ink.

EP 1 810 756 A2 discloses apparatus for orienting magnetic flakes, such as during a painting or printing process, to obtain an illusive optical effect. The disclosed apparatus comprises a rotatable roller comprising a non-magnetic cylindrical body having cavities formed therein and permanent magnets positioned in said cavities for forming magnetized portions of the roller, the one or more permanent magnets shaped for creating the magnetic field of the pre-determined configuration. Alternatively, EP 1 810 756 A2 discloses a cylindrical body encased by a flexible sheet of a magnetic material which is selectively magnetized for providing magnetized portions of the roller.

WO 2010/066838 A1 discloses a device for producing indicia comprising magnetically oriented magnetic or magnetizable particles in an ink or coating composition on a sheet of substrate material. The disclosed device comprises a flat-bed screen-printing and a printing platen for receiving said sheet, said printing platen having an upper surface facing the printing screen and a first direction along its upper surface along which said sheet is unloadable, and a magnetic orienting unit comprising multiple magnet assemblies. The magnetic orienting unit is disposed below the upper surface of the printing platen and all of said magnet assemblies are concomitantly movable from a first position away from the upper surface of the printing platen to a second position close to the upper surface of the printing platen.

A need remains for printing devices for high-speed productions of magnetically induced optical effect layers, said devices providing an increased contact time between the magnetic elements and the not yet hardened coating composition comprising magnetic or magnetizable pigment particles without the dimensional constraints of conventional cylindrical bodies having cavities comprising the magnetic elements and while allowing freedom in terms of the choice of the printing process and coating compositions comprising magnetic or magnetizable pigment particles.

SUMMARY OF THE INVENTION

Accordingly, it is an object of the present invention to overcome the deficiencies of the prior art as discussed above. This is achieved by the provision of printing devices for producing magnetically induced optical effect layers on a substrate, said printing device comprising:

a) an orienting device for orienting magnetic or magnetizable pigment particles in a coating composition on the substrate, the orienting device comprising an orientation means, said orientation means being either a magnetic field generating belt or a non-magnetic belt comprising magnetic field generating elements, said belt being driven by at least two rollers; and b) a hardening unit. The hardening unit is for hardening the coating composition to fix an orientation of the magnetic or magnetizable pigment particles.

Also described and claimed therein are uses of the printing device described herein to produce a magnetically induced optical effect layer on a substrate.

Also described and claimed herein are processes for producing magnetically induced optical effect layers on a substrate and magnetically induced optical effect layers obtained thereof, said process comprising the steps of:

a) applying a coating composition comprising magnetic or magnetizable pigment particles and a fluid binder on the substrate, said coating composition being in a first state;
b) exposing the coating composition in a first state to the magnetic field of the orientation means described herein thereby orienting at least a part of the magnetic or magnetizable pigment particles; and
c) hardening by the hardening unit described herein the coating composition to a second state so as to fix the magnetic or magnetizable pigment particles in their adopted positions and orientations.

The present invention advantageously provides freedom in terms of coating compositions for producing magnetically induced optical effect layers with respect to the printing process, viscosity of the coating composition and hardening mechanism while preserving a high quality of the produced optical effect layers and while preserving a suitable or decent size of the printing device.

Irrespective of the viscosity and/or the hardening mechanism of the coating composition comprising magnetic or magnetizable pigment particles for producing magnetically induced optical effect layers, the quality of said magnetically induced optical effect layers is increased by the use of the printing device described herein.

When a highly viscous coating composition, such as for example an intaglio coating composition (also referred in the art as engraved steel die or copper plate coating composition), is used to produce magnetically induced optical effect layers, the printing devices described herein may advantageously allow an increased exposure time of the magnetic or magnetizable pigment particles with the orientation means without adversely affecting the size of the printing device. Whereas the exposure time may be increased by increasing the diameter of the roller of conventional printing devices, this would negatively results in printing devices of high volume.

When a composition requiring a long hardening time such as for example solvent-based low viscosity coating compositions and water-based low viscosity compositions is used to produce magnetically induced optical effect layers, the printing devices of the present invention may advantageously allow an increased exposure time of the coating composition comprising the magnetic or magnetizable pigment particles with the hardening unit so as to ensure that the magnetic orientation of the pigment particles is preserved until the hardening is achieved.

BRIEF DESCRIPTION OF DRAWINGS

The printing device according to the present invention and processes for producing OELs are now described in more detail with reference to the drawings and to particular embodiments, wherein FIG. 1 schematically illustrates a printing device for producing optical effect layers on a substrate according to an embodiment of the present invention FIG. 2 schematically illustrates an alternative embodiment of a printing device for producing optical effect layers on a substrate according to an embodiment of the present invention

DETAILED DESCRIPTION

Definitions

Figure 1:
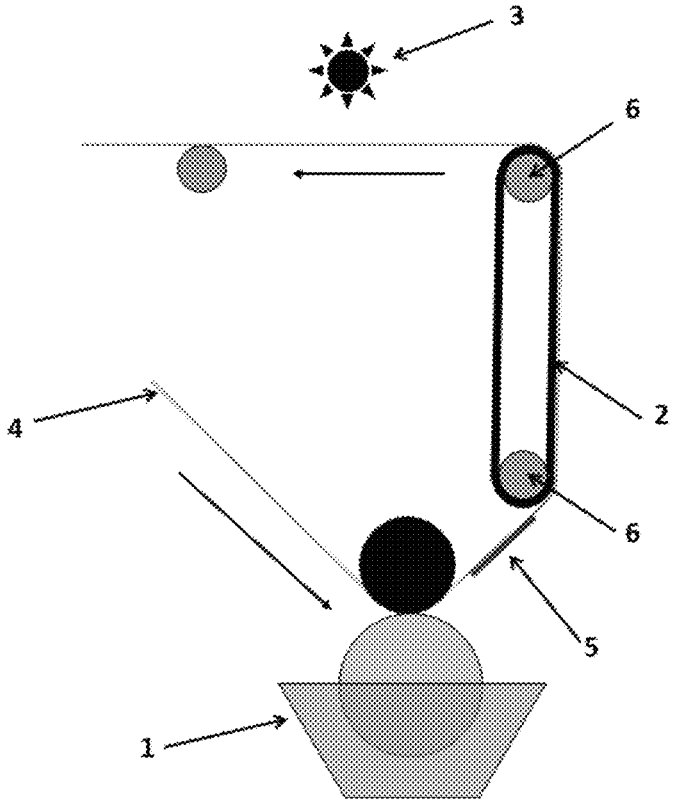

The following definitions are to be used to interpret the meaning of the terms discussed in the description and recited in the claims.

The following definitions are to be used to interpret the meaning of the terms discussed in the description and recited in the claims.

As used herein, the indefinite article "a" indicates one as well as more than one and does not necessarily limit its referent noun to the singular.

As used herein, the term "about" means that the amount, value or limit in question may be the specific value designated or some other value in its neighborhood. Generally, the term "about" denoting a certain value is intended to denote a range within ±5% of the value. As one example, the phrase "about 100" denotes a range of 100±5, i.e. the range from 95 to 105. Generally, when the term "about" is used, it can be expected that similar results or effects according to the invention can be obtained within a range of ±5% of the indicated value. However, a specific amount, value or limit supplemented with the term "about" is intended herein to disclose as well the very amount, value or limit as such, i.e. without the "about" supplement.

As used herein, the term "and/or" means that either all or only one of the elements of said group may be present. For example, "A and/or B" shall mean "only A, or only B, or both A and B". In the case of "only A", the term also covers the possibility that B is absent, i.e. "only A, but not B".

The term "at least partially" is intended to denote that the following property is fulfilled to a certain extent or completely. Preferably, the term denotes that the following property is fulfilled to at least 50% or more.

The terms "substantially" and "essentially" are used to denote that the following feature, property or parameter is either completely (entirely) realized or satisfied or to a major degree that does adversely affect the intended result. Thus, the term "substantially" or "essentially" preferably means at least 80%.

The term "comprising" as used herein is intended to be non-exclusive and open-ended. Thus, for instance a coating composition comprising a compound A may include other compounds besides A. However, the term "comprising" also covers, as a particular embodiment thereof, the more restrictive meanings of "consisting essentially of" and "consisting of", so that for instance "a coating composition comprising a compound A" may also (essentially) consist of the compound A.

The term "coating composition" refers to any composition which is capable of forming an optical effect layer on a solid substrate and which can be applied preferentially but not exclusively by a printing method. The coating composition comprises at least the magnetic or magnetizable pigment particles described herein and a binder.

The term "optical effect layer (OEL)" as used herein denotes a layer that comprises magnetically oriented magnetic or magnetizable pigment particles and a binder, wherein the orientation of the magnetic or magnetizable pigment particles is fixed within the binder so as to form a magnetically induced image.

As used herein, the term "optical effect coated substrate (OEC)" is used to denote the product resulting from the provision of the OEL on a substrate. The OEC may consist of the substrate and the OEL, but may also comprise other materials and/or layers other than the OEL.

The term "security element" or "security feature" is used to denote an image or graphic element that can be used for authentication purposes. The security element or security feature can be an overt and/or a covert security element.

The term "partially simultaneously" as used herein denotes that two steps are partly performed simultaneously, i.e. the times of performing each of the steps partially overlap.

Figure 2:
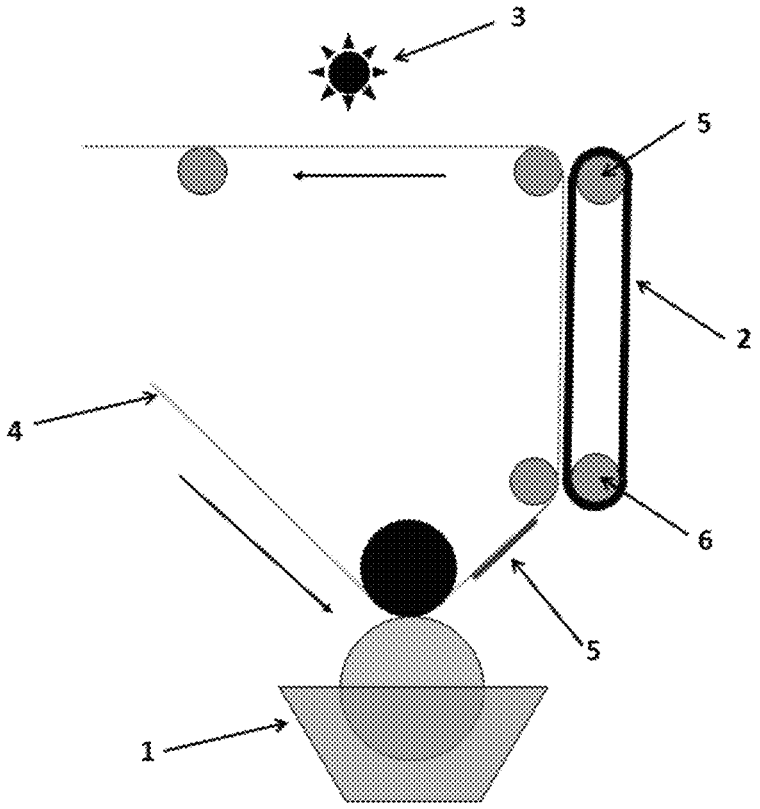

As shown in FIGS. 1-2, the present invention relates to printing devices for producing optical effect layers, said devices comprising, in addition to a hardening unit (3), an orienting device comprising an orientation means (2) suitable for orienting magnetic or magnetizable pigment particles dispersed in a fluid binder, said orientation means being either a magnetic field generating belt (2) or a non-magnetic belt (2) comprising magnetic field generating elements, wherein said belt is driven by at least two rollers (6). As shown in FIGS. 1-2, the printing device described herein may further comprises a printing unit (1), said printing unit being suitable for applying a coating composition (5) comprising magnetic or magnetizable pigment particles in a fluid binder on a substrate (4).

The coating composition described herein comprises the magnetic or magnetizable pigment particles described herein and a fluid binder described herein. The coating composition described herein is applied on the substrate described herein preferably by a printing process preferably selected from the group consisting of screen printing, rotogravure printing, flexography printing and intaglio printing. Therefore, the printing device described herein may further comprises a printing unit (1) arranged to apply a coating composition (5) comprising magnetic or magnetizable pigment particles in a fluid binder on the substrate. The printing unit is preferably selected from the group consisting of screen printing unit, rotogravure printing unit, flexography printing unit and intaglio printing unit.

The so-obtained substrate comprising the coating composition described herein is subjected to the magnetic field through the use the orienting device comprising the orientation means described herein, thus aligning the magnetic or magnetizable pigment particles along the field lines of the magnetic field generated by the orientation device.

Subsequently, partially simultaneously or simultaneously with the magnetic orientation of the magnetic or magnetizable pigment particles, the orientation of the magnetic or magnetizable pigment particles is fixed or frozen.

The printing device described herein comprises an orienting device for orienting the magnetic or magnetizable pigment particles, said orienting device comprising an orientation means (2) being either a magnetic field generating belt (2) or a non-magnetic belt (2) comprising magnetic field generating elements, said belt (2) being driven by at least two rollers (6). In other words, the belt bends around at least two rollers. The magnetic field generating belt described herein and the non-magnetic belt described herein may be described as having a ratio (distance between the center of the two outmost rollers driving the belt)/(radius of the roller having the largest radius) greater than 1, preferably greater than 1.5 and even more preferably equal to or greater than 2.0.

The outer surface of the movable belt (2) is substantially even for providing a surface contact and thus allowing the positioning of the substrate (4) comprising the coating composition comprising the magnetic or magnetizable pigment particles (5). The belt (2) may face the substrate (4) (see FIG. 1) or may face the coating composition (5) (see FIG. 2), provided that the coating composition (5) is not in direct contact with the belt (2) and allows the creation of a magnetic field of a pre-determined configuration to orient the magnetic or magnetizable pigment particles.

According to one embodiment of the present invention, the magnetic belt described herein is a continuous belt, i.e. a flexible single piece belt. The magnetic continuous belt described herein is preferably made of a magnetic flexible material, that is, a material which is made of particles of a strong magnetic material bonded in an elastomeric or a thermoplastic polymer. Suitable strong magnetic materials are materials having a maximum value of energy product $(BH)_{max}$ of at least 20 kJ/m$^3$, preferably at least 50 kJ/m$^3$, more preferably at least 100 kJ/m$^3$, even more preferably at least 200 kJ/m$^3$. They are selected from the group consisting of Alnicos such as for example Alnico 5 (R1-1-1), Alnico 5 DG (R1-1-2), Alnico 5-7 (R1-1-3), Alnico 6 (R1-1-4), Alnico 8 (R1-1-5), Alnico 8 HC (R1-1-7) and Alnico 9 (R1-1-6); ferrites such as for example strontium hexaferrite ($SrFe_{12}O_{19}$), barium hexaferrite ($BaFe_{12}O_{19}$), hard ferrites of the formula $MFe_2O_4$ (e.g. as cobalt ferrite ($CoFe_2O_4$) or magnetite ($Fe_3O_4$)), wherein M is a bivalent metal ion, ceramic 5 (SI-1-6), ceramic 7 (SI-1-2), ceramic 8 (SI-1-5); rare earth magnet materials selected from the group comprising $RECo_5$ (with RE=Sm or Pr), $RE_2TM_{17}$ (with RE=Sm, TM=Fe, Cu, Co, Zr, Hf), $RE_2TM_{14}B$ (with RE=Nd, Pr, Dy, TM=Fe, Co); anisotropic alloys of Fe Cr Co; materials selected from the group of PtCo, MnAlC, RE Cobalt 5/16, RE Cobalt 14. Preferred are strontium hexaferrite, barium hexaferrite, $SmCo_5$ and $Nd_2Fe_{14}B$ (abbreviated NdFeB).

Suitable elastomeric or thermoplastic polymers include natural rubber, synthetic rubbers like SBR (styrene-butadiene rubber), NBRs (nitrile-butadiene rubber), neoprenes (chloroprene rubber), polyvinylchlorides (PVC), PTFEs (Teflon®), polypropylenes (PP), polyamides (Nylon®), copolyetheresters as well as blends thereof.

The magnetic continuous belt described herein may be combined with an additional supporting belt, said supporting belt being either continuous (i.e. a flexible supporting belt) or discontinuous (i.e. an assembly comprising more than one piece). In an embodiment, the supporting belt is continuous. In this case, the magnetic belt described herein is a 2-part continuous belt comprising a lower, flexible, non-magnetic supporting belt and an upper belt made of a magnetic material as described hereabove. As used herein, the term "lower" refers to the part of the 2-part belt which is in contact with the rollers, i.e. the part intended to transmit the mechanical force from the rollers and to resist wear and tear on long-term use, whereas the term "upper" refers to the part of the 2-part belt comprising particles of a strong magnetic material as described hereabove.

The continuous supporting belt may be any kind of belt intended to transmit strong mechanical forces and to withstand long-term use as known to those skilled in the art. The supporting belt preferably comprises a flexible material reinforced with threads or yarns that are disposed longitudinally (i.e. along the length of the belt) and/or transversally (i.e. crosswise along the width of the belt) within the flexible material. The threads or yarns are intended to increase the resistance of the 2-part continuous belt to wear and tear and to enhance its longitudinal stability (i.e. to allow for steady transmission of the mechanical forces from the rollers). The flexible material comprises one or more polymers selected from the group consisting of elastomeric and thermoplastic polymers such as those described hereabove. Suitable elastomeric polymers include for example natural rubber, neoprene, NBR (nitrile butadiene rubber), SBR (styrene-butadiene rubber), silicone rubber and EPDM (ethylene-propylene-diene monomer). Suitable thermoplastic polymers include for example polyurethane, polyamide (Nylon®), polyvinylchloride (PVC) and PTFE (Teflon®). Optionally, the flexible material further comprises additives, such as fillers, surfactants, pigments, plasticizers, UV-absorbers, stabilizers and the like. The reinforcing threads or yarns are made from any threadable or extrudable material known to somebody skilled in the art, like cotton, steel, fiberglass, polyester (Mylar®), polyamide (Nylon®), aramide (Kevlar®) and rayon (regenerated cellulose fiber). Within the scope of the invention described herein, Aramide (Kevlar®), fiberglass and polyamide (Nylon®) are preferred.

Preferably, the supporting belt comprises a plurality of trapezoidal or V-shaped elements intended to improve transversal alignment and cancel the risk of sudden and complete belt failure.

The upper part of the 2-part continuous belt is made of the same materials described hereabove for the continuous single-piece belt. The two parts of the belt are linked together by any mean known to people skilled in art, including gluing, riveting, screwing, sewing and the like. Alternatively, when the upper part of the 2-part continuous belt comprises one or more elastomeric thermoplastic polymers, it may be directly coated in a fluid form onto the supporting belt (suitable temperature being above the melting temperature of the one or more thermoplastic polymers but below the Curie temperature of the strong magnetic material) and subsequently cooled down below the melting temperature of the one or more thermoplastic polymers.

According to another embodiment of the present invention, the magnetic belt described herein is a discontinuous belt or a chain-like magnetic belt, i.e. an assembly comprising more than one pieces such as for example chain elements. The discontinuous belt described herein preferably comprising more than one chain elements, said chain elements being either made of one or more engineering polymers or plastics including without limitation polyamides, polyesters, copolyetheresters, high-density polyethylenes, polystyrenes, polycarbonates and liquid crystal polymers, preferably one or more low friction materials such as for example polytetrafluoroethylene resins (PTFE) and polyacetal resins (also called polyoxymethylene, POM), and one or more magnetic materials dispersed therein, wherein said one or more magnetic materials are preferably high coercivity permanent materials and are more preferably selected from the group consisting of hexaferrites of formula $MFe_{12}O_{19}$, (e.g. strontium hexaferrite ($SrO*6Fe_2O_3$) or barium hexaferrites ($BaO*6Fe_2O_3$)), hard ferrites of the formula $MFe_2O_4$ (e.g. as cobalt ferrite ($CoFe_2O_4$) or magnetite ($Fe_3O_4$)), wherein M is a bivalent metal ion, samarium-cobalt alloys, rare-earth-iron-boron alloys ($RE_2Fe_{14}B$, e.g. $Nd_2Fe_{14}B$), wherein RE is a trivalent rare earth ion or a mixture of trivalent rare earth ions and mixtures thereof. The discontinuous belt described herein may be a combination of the chain elements described hereabove and non-magnetic chain elements.

In an embodiment, the belt is formed into a loop comprising first and second straight sections each extending between rollers, the printing device being arranged so that the substrate is disposed on at least one of the first and second straight sections while the magnetic field generated by the belt orients the magnetic or magnetizable pigment particles for creating an optical effect layer. In an embodiment, the loop is elongate and is comprised of first and second 180° turns defined by rollers at opposed longitudinal ends of the elongate loop and first and second straight sections extending between the opposed turns, one of the straight sections being disposed adjacent the substrate.

The rollers (6) serve to define a loop or path that the belt (2) follows, as well as to maintain the belt (2) in tension. In the shown embodiment, the belt follows a path with straight sections extending between opposed 180° turns about rollers (6) disposed at opposed longitudinal ends of the path of the belt (2). A straight section of the belt (2) adjacent the substrate can be suitably dimensioned in a design convenient way to ensure sufficient contact time between the magnetic field generated by the belt (2) and the coating composition (5) for thoroughly orienting the magnetic or magnetizable pigment particles to produce a sufficiently contrasted optical effect layer.

Alternatively, the orientation means of the printing device described herein is a non-magnetic belt comprising one or more magnetic field generating elements, said magnetic field generating elements being encased within the non-magnetic belt, wherein said magnetic field generating elements are recessed relative to the outer surface of the non-magnetic belt to ensure an outer surface of the movable belt substantially even for positioning the substrate. The non-magnetic belt may be a non-magnetic continuous belt (i.e. a flexible single piece belt) or may be a non-magnetic discontinuous belt (a belt comprising more than one piece). The non-magnetic continuous belt described herein may be combined with an additional supporting belt, said supporting belt being either continuous (i.e. a flexible supporting belt) or discontinuous (i.e. an assembly comprising more than one pieces). When the non-magnetic belt is a non-magnetic continuous belt, said belt is preferably made of one or more materials selected from the group consisting of elastomeric and thermoplastic polymers, such as those described hereabove. Preferably, the non-magnetic continuous belt is further reinforced with threads or yarns as described hereabove for the supporting belt. Preferably, the non-magnetic continuous belt comprises a plurality of trapezoidal or V-shaped elements. Also preferably, the non-magnetic continuous belt is a timing belt (or toothed, or synchronous belt), which allows for very precise transmission of the rollers' movement. In this case, the rollers are driven by stepping motors controlled via a computer or any other motor control unit, and at least one circumferential edge of at least one roller is equipped with an array of detectors that work in a feedback loop with the motor control unit. Alternatively, the rollers may be driven by toothed belts or gears connected with the substrate feeder. In all embodiments comprising magnetic field-generating elements encased within a non-magnetic belt, the rollers and the belt are configured in such a way as to generate perfect register between the magnetic field generating elements and the part of the substrate carrying the coating composition comprising the magnetic or magnetizable pigment particles.

When the non-magnetic belt is a non-magnetic discontinuous belt or a chain-like belt comprising more than one pieces, said pieces are preferably made i) one or more engineering polymers or plastics including without limitation polyaryletherketones, polyacetals, polyam ides, polyesters, polyethers, copolyetheresters, polyimides, polyetherim ides, high-density polyethylene (HDPE), ultra-high molecular weight polyethylene (UHMWPE), polybutylene terephthalate (PBT), polypropylene, acrylonitrile butadiene styrene (ABS) copolymer, fluorinated and perfluorinated polyethylenes, polystyrenes, polycarbonates, polyphenylenesulfide (PPS) and liquid crystal polymers, more preferably. low-friction materials such as POM (polyoxymethylene), PEEK (poly ether ether ketone), PTFE (polytetrafluoroethylene), Nylon® (polyamide) and PPS, or ii) one or more non-magnetic metals selected from the group consisting of aluminum, stainless steel and titanium.

Magnetic field generating elements consist of magnets. Depending on the design chosen for the optical effect layer, the magnets may be permanent magnets, non-permanent magnets or combinations thereof, permanent magnets being preferred. Typical example of permanent magnets include without limitation magnets made of sintered or polymer bonded magnetic material selected from the group consisting of Alnicos such as for example Alnico 5 (R1-1-1), Alnico 5 DG (R1-1-2), Alnico 5-7 (R1-1-3), Alnico 6 (R1-1-4), Alnico 8 (R1-1-5), Alnico 8 HC (R1-1-7) and Alnico 9 (R1-1-6); ferrites such as for example strontium hexaferrite ($SrFe_{12}O_{19}$), barium hexaferrite, ceramic 5 (SI-1-6), ceramic 7 (SI-1-2), ceramic 8 (SI-1-5); rare earth magnet materials selected from the group comprising $RECo_5$ (with RE=Sm or Pr), $RE_2TM_{17}$ (with RE=Sm, TM=Fe, Cu, Co, Zr, Hf), $RE_2TM_{14}B$ (with RE=Nd, Pr, Dy, TM=Fe, Co); anisotropic alloys of Fe Cr Co; materials selected from the group of PtCo, MnAlC, RE Cobalt 5/16, RE Cobalt 14.

The orientation means is configured to produce the desired optical effect layer dynamic, three-dimensional, illusionary, and/or kinematic images. A large variety of optical effects for decorative and security applications can be produced by various methods disclosed for example in U.S. Pat. No. 6,759,097, EP 2 165 774 A1 and EP 1 878 773 B1. Optical effects known as flip-flop effects (also referred in the art as switching effect) may be produced. Flip-flop effects include a first printed portion and a second printed portion separated by a transition, wherein pigment particles are aligned parallel to a first plane in the first portion and pigment particles in the second portion are aligned parallel to a second plane. Methods for producing flip-flop effects are disclosed for example in EP 1 819 525 B1 and EP 1 819 525 B1. Optical effects known as rolling-bar effects may also be produced. Rolling-bar effects show one or more contrasting bands which appear to move ("roll") as the image is tilted with respect to the viewing angle, said optical effects are based on a specific orientation of magnetic or magnetizable pigment particles, said pigment particles being aligned in a curving fashion, either following a convex curvature (also referred in the art as negative curved orientation) or a concave curvature (also referred in the art as positive curved orientation). Methods for producing rolling-bar effects are disclosed for example in EP 2 263 806 A1, EP 1 674 282 B1, EP 2 263 807 A1, WO 2004/007095 A2 and WO 2012/104098 A1. Optical effects known as Venetian-blind effects may also be produced. Venetian-blind effects include pigment particles being oriented such that, along a specific direction of observation, they give visibility to an underlying substrate surface, such that indicia or other features present on or in the substrate surface become apparent to the observer while they impede the visibility along another direction of observation. Methods for producing Venetian-blind effects are disclosed for example in U.S. Pat. No. 8,025,952 and EP 1 819 525 B1. Optical effects known as moving-ring effects may also be produced. Moving-ring effects consists of optically illusive images of objects such as funnels, cones, bowls, circles, ellipses, and hemispheres that appear to move in any x-y direction depending upon the angle of tilt of said optical effect layer. Methods for producing moving-ring effects are disclosed for example in EP 1 710 756 A1, U.S. Pat. No. 8,343,615, EP 2 306 222 A1, EP 2 325 677 A2, WO 2011/092502 A2 and US 2013/084411.

Partially simultaneously, simultaneously, or subsequently to orientation of the magnetic or magnetizable pigment particles, the coating composition is made to harden (i.e. turned to a solid or solid-like state) in order to fix the orientation of the particles. By "partially simultaneously", it is meant that both steps are partly performed simultaneously, i.e. the times of performing each of the steps partially overlap. Consequently, the printing device described herein may comprise the hardening unit (3) arranged so as to harden the coating composition on the substrate while the substrate is in contact with or otherwise disposed on the orientation means (partially simultaneous or simultaneous magnetic orientation and hardening) or may comprise the hardening unit arranged so as to harden the coating composition on the substrate while it is not any more in contact with the orientation means (hardening subsequent to the magnetic orientation).

Hardening consists of a step that consists of increases of the viscosity of the coating composition such that a substantially solid material adhering to the substrate is formed. Hardening may involve a physical process based on the evaporation of a volatile component, such as a solvent, and/or water evaporation (i.e. physical or thermal drying). Herein, hot air, infrared or a combination of hot air and infrared may be used. Alternatively, hardening may include a chemical reaction, such as a curing, polymerizing or cross-linking of the binder and optional initiator compounds and/or optional cross-linking compounds comprised in the coating composition. Such a chemical reaction may be initiated by heat or IR irradiation as outlined above for the physical hardening processes, but may preferably include the initiation of a chemical reaction by a radiation mechanism including without limitation Ultraviolet-Visible light radiation curing (hereafter referred as UV-Vis curing) and electronic beam radiation curing (E-beam curing); oxypolymerization (oxidative reticulation, typically induced by a joint action of oxygen and one or more catalysts preferably selected from the group consisting of cobalt-containing catalysts, vanadium-containing catalysts, zirconium-containing catalysts, bismuth-containing catalysts and manganese-containing catalysts); cross-linking reactions or any combination thereof. Such a curing is generally induced by applying an external stimulus to the coating composition (i) after its application on a substrate and (ii) subsequently or simultaneously with the orientation of the magnetic or magnetizable pigment particles. Therefore, preferably the coating composition is an ink or coating composition selected from the group consisting of radiation curable compositions, thermal drying compositions, oxidatively drying compositions, and combinations thereof. Radiation curing, in particular UV-Vis curing, advantageously lead to very fast curing processes and hence drastically decrease the preparation time of any article comprising the OEL described herein due to an instantaneous increase in viscosity of the coating composition after exposure to the curing radiation, thus preventing any further movement of the pigment particles and in consequence any loss of information after the magnetic orientation step.

Preferably, the hardening unit comprises one or more radiation sources and/or one or more heaters (such as for example hot air heaters, infrared heaters or heaters comprising a combination of hot air and infrared). The hardening unit may be used to either fully cure the coating composition comprising the magnetic or magnetizable pigment particles, or to partially cure the coating composition to such a degree of viscosity to secure the magnetic or magnetizable pigment particles from completely or partially losing their orientation during and/or after the substrate has been removed from the magnetic field. In the case of only partial curing of the coating composition, the curing is completed after the substrate has been removed for the magnetic field by performing an additional thermal and/or photochemical treatment of the coating composition.

The one or more radiation sources described herein are preferably UV-lamps. The one or more UV-lamps are preferably selected from the group consisting of light emitting Diode (LED) UV-lamps, arc discharge lamps (such as a medium-pressure mercury arc (MPMA) or a metal-vapor arc lamp), mercury lamps and combination thereof. The one or more mercury lamps may be equipped with at least one dichroic reflector which is configured to direct the radiation corresponding to UV-spectra wavelengths towards the coated substrate and to direct the radiation corresponding to the IR-spectrum wavelengths away from the coated substrate. Alternatively, the one or more mercury lamps may be implemented as a UV lamp equipped with a waveguide directing the irradiation energy towards the coated substrate. Point sources, line sources and arrays ("lamp curtains") are suitable radiation sources of the hardening unit. Examples are carbon arc lamps, xenon arc lamps, medium-, super high-, high- and low-pressure mercury lamps, possibly with metal halide doped (metal-halogen lamps), microwave-stimulated metal vapor lamps, excimer lamps, super-actinic fluorescent tubes, fluorescent lamps, argon incandescent lamps, electronic flashlights, photographic flood lamps and lasers.

According to one embodiment of the present invention, the printing device described herein comprises the hardening unit (3) arranged so as to harden the coating composition on the substrate while it is not any more in contact with the orientation means (hardening subsequent to the magnetic orientation).

According to another embodiment of the present, the printing device described herein comprises the hardening unit (3) arranged so as to harden the coating composition on the substrate while the substrate is in contact with or otherwise disposed on the orientation means (partially simultaneous or simultaneous magnetic orientation and hardening), wherein the orientation means is placed within an oven-like structure. Such an embodiment may be advantageously used for producing an OEL based on a composition requiring a long hardening time such as for examples solvent-based low viscosity coating compositions and water-based low viscosity compositions, since it allows an increased exposure time of the coating composition comprising the magnetic or magnetizable pigment particles with the hardening unit so as to ensure that the magnetic orientation of the pigment particles is preserved until the hardening is achieved. Such an embodiment may be advantageously used for producing an OEL based on a highly viscous coating composition, such as for example an intaglio coating composition, a polymeric thermoplastic based composition or a thermoset based composition since it allows a temporary reduction of the viscosity of said coating composition during orientation of the magnetic or magnetizable pigment particles.

As well known to the man skilled in the art, the choice of the binder comprised in the coating composition described herein depends not only on the printing process but also on the hardening mechanism.

According to one embodiment, the coating composition described herein is a radiation curable coating composition. Radiation curable coating compositions include compositions that may be hardened by UV-visible light radiation (hereafter referred as UV-Vis-curable) or by E-beam radiation (hereafter referred as EB). Radiation curable compositions are known in the art and can be found in standard textbooks such as the series "Chemistry & Technology of UV & EB Formulation for Coatings, Inks & Paints", Volume IV, Formulation, by C. Lowe, G. Webster, S. Kessel and I. McDonald, 1996 by John Wiley & Sons in association with SITA Technology Limited. According to one particularly preferred embodiment of the present invention, the coating composition described herein is a UV-Vis-curable coating composition. UV-Vis curing advantageously allows very fast curing processes and hence drastically decreases the preparation time of the OEL described herein, OEC described herein and articles and documents comprising said OEL. Preferably, the UV-Vis-curable coating composition comprises one or more compounds selected from the group consisting of radically curable compounds, cationically curable compounds and mixtures thereof.

According to one embodiment, the coating composition described herein is a solvent-based coating composition. Solvent-based coating composition includes compositions that may be hardened by evaporation of the volatile component, such as a solvent, and/or water evaporation. Herein, hot air, infrared or a combination of hot air and infrared may be used.

Alternatively, a polymeric thermoplastic binder material or a thermoset may be employed. Unlike thermosets, thermoplastic resins can be repeatedly melted and solidified by heating and cooling without incurring any important changes in properties. Typical examples of thermoplastic resin or polymer include without limitation polyam ides, polyesters, polyacetals, polyolefins, styrenic polymers, polycarbonates, polyarylates, polyimides, polyether ether ketones (PEEK), polyetherketoneketones (PEKK), polyphenylene based resins (e.g. polyphenylenethers, polyphenylene oxides, polyphenylene sulfides), polysulphones and mixtures of these.

The coating compositions described herein comprise magnetic or magnetizable pigment particles, preferably non-spherical magnetic or magnetizable pigment particles.

Non-spherical magnetic or magnetizable pigment particles described herein are defined as having, due to their non-spherical shape, non-isotropic reflectivity with respect to an incident electromagnetic radiation for which the hardened binder material is at least partially transparent. As used herein, the term "non-isotropic reflectivity" denotes that the proportion of incident radiation from a first angle that is reflected by a particle into a certain (viewing) direction (a second angle) is a function of the orientation of the particles, i.e. that a change of the orientation of the particle with respect to the first angle can lead to a different magnitude of the reflection to the viewing direction. The non-spherical magnetic or magnetizable pigment particles are preferably prolate or oblate ellipsoid-shaped, platelet-shaped or needle-shaped particles or a mixture of two or more thereof and more preferably platelet-shaped particles.

Suitable examples of magnetic or magnetizable pigment particles, in particular non-spherical magnetic or magnetizable pigment particles, described herein include without limitation pigment particles comprising a magnetic metal selected from the group consisting of cobalt (Co), iron (Fe), gadolinium (Gd) and nickel (Ni); a magnetic alloy of iron, manganese, cobalt, nickel or a mixture of two or more thereof; a magnetic oxide of chromium, manganese, cobalt, iron, nickel or a mixture of two or more thereof; or a mixture of two or more thereof. The term "magnetic" in reference to the metals, alloys and oxides is directed to ferromagnetic or ferrimagnetic metals, alloys and oxides. Magnetic oxides of chromium, manganese, cobalt, iron, nickel or a mixture of two or more thereof may be pure or mixed oxides. Examples of magnetic oxides include without limitation iron oxides such as hematite ($Fe_2O_3$), magnetite ($Fe_3O_4$), chromium dioxide ($CrO_2$), magnetic ferrites ($MFe_2O_4$), magnetic spinels ($MR_2O_4$), magnetic hexaferrites ($MFe_{12}O_{19}$), magnetic orthoferrites ($RFeO_3$), magnetic garnets $M_3R_2(AO_4)_3$, wherein M stands for two-valent metal, R stands for three-valent metal, and A stands for four-valent metal.

Examples of magnetic or magnetizable pigment particles, in particular non-spherical magnetic or magnetizable pigment particles, described herein include without limitation pigment particles comprising a magnetic layer M made from one or more of a magnetic metal such as cobalt (Co), iron (Fe), gadolinium (Gd) or nickel (Ni); and a magnetic alloy of iron, cobalt or nickel, wherein said magnetic or magnetizable pigment particles may be multilayered structures comprising one or more additional layers. Preferably, the one or more additional layers are layers A independently made from one or more selected from the group consisting of metal fluorides such as magnesium fluoride ($MgF_2$), silicium oxide (SiO), silicium dioxide ($SiO_2$), titanium oxide ($TiO_2$), and aluminum oxide ($Al_2O_3$), more preferably silicium dioxide ($SiO_2$); or layers B independently made from one or more selected from the group consisting of metals and metal alloys, preferably selected from the group consisting of reflective metals and reflective metal alloys, and more preferably selected from the group consisting of aluminum (Al), chromium (Cr), and nickel (Ni), and still more preferably aluminum (Al); or a combination of one or more layers A such as those described hereabove and one or more layers B such as those described hereabove. Typical examples of the magnetic or magnetizable pigment particles being multilayered structures described hereabove include without limitation NM multilayer structures, A/M/A multilayer structures, A/M/B multilayer structures, A/B/M/A multilayer structures, A/B/M/B multilayer structures, A/B/M/B/A/multilayer structures, B/M multilayer structures, B/M/B multilayer structures, B/A/M/A multilayer structures, B/NM/B multilayer structures, B/NM/B/A/multilayer structures, wherein the layers A, the magnetic layers M and the layers B are chosen from those described hereabove.

The coating compositions described herein may comprise optically variable magnetic or magnetizable pigment particles, in particular non-spherical optically variable magnetic or magnetizable pigment particles, and/or non-spherical magnetic or magnetizable pigment particles, in particular non-spherical, having no optically variable properties. Preferably, at least a part of the magnetic or magnetizable pigment particles described herein is constituted by optically variable magnetic or magnetizable pigment particles, in particular non-spherical optically variable magnetic or magnetizable pigment particles. In addition to the overt security provided by the colorshifting property of the optically variable magnetic or magnetizable pigment particles, which allows easily detecting, recognizing and/or discriminating an article or security document carrying an ink, coating composition, coating or layer comprising the optically variable magnetic or magnetizable pigment particles described herein from their possible counterfeits using the unaided human senses, the optical properties of the optically variable magnetic or magnetizable pigment particles may also be used as a machine readable tool for the recognition of the OEL. Thus, the optical properties of the optically variable magnetic or magnetizable pigment particles may simultaneously be used as a covert or semi-covert security feature in an authentication process wherein the optical (e.g. spectral) properties of the pigment particles are analyzed.

The use of non-spherical optically variable magnetic or magnetizable pigment particles in coating compositions for producing an OEL enhances the significance of the OEL as a security feature in security document applications, because such materials (i.e. non-spherical optically variable magnetic or magnetizable pigment particles) are reserved to the security document printing industry and are not commercially available to the public.

As mentioned above, preferably at least a part of the magnetic or magnetizable pigment particles is constituted by optically variable magnetic or magnetizable pigment particles, in particular non-spherical optically variable magnetic or magnetizable pigment particles. These can more preferably be selected from the group consisting of magnetic thin-film interference pigment particles, magnetic cholesteric liquid crystal pigment particles, interference coated pigment particles comprising a magnetic material and mixtures of two or more thereof. The magnetic thin-film interference pigment particles, magnetic cholesteric liquid crystal pigment particles and interference coated pigment particles comprising a magnetic material described herein are preferably prolate or oblate ellipsoid-shaped, platelet-shaped or needle-shaped particles or a mixture of two or more thereof and more preferably platelet-shaped particles.

Magnetic thin film interference pigment particles are known to those skilled in the art and are disclosed e.g. in U.S. Pat. No. 4,838,648; WO 2002/073250 A2; EP 0 686 675 B1; WO 2003/000801 A2; U.S. Pat. No. 6,838,166; WO 2007/131833 A1; EP 2 402 401 A1 and in the documents cited therein. Preferably, the magnetic thin film interference pigment particles comprise pigment particles having a five-layer Fabry-Perot multilayer structure and/or pigment particles having a six-layer Fabry-Perot multilayer structure and/or pigment particles having a seven-layer Fabry-Perot multilayer structure.

Preferred five-layer Fabry-Perot multilayer structures consist of absorber/dielectric/reflector/dielectric/absorber multilayer structures wherein the reflector and/or the absorber is also a magnetic layer, preferably the reflector and/or the absorber is a magnetic layer comprising nickel, iron and/or cobalt, and/or a magnetic alloy comprising nickel, iron and/or cobalt and/or a magnetic oxide comprising nickel (Ni), iron (Fe) and/or cobalt (Co).

Preferred six-layer Fabry-Perot multilayer structures consist of absorber/dielectric/reflector/magnetic/dielectric/absorber multilayer structures.

Preferred seven-layer Fabry Perot multilayer structures consist of absorber/dielectric/reflector/magnetic/reflector/dielectric/absorber multilayer structures such as disclosed in U.S. Pat. No. 4,838,648.

Preferably, the reflector layers described herein are independently made from one or more selected from the group consisting of metals and metal alloys, preferably selected from the group consisting of reflective metals and reflective metal alloys, more preferably selected from the group consisting of aluminum (Al), silver (Ag), copper (Cu), gold (Au), platinum (Pt), tin (Sn), titanium (Ti), palladium (Pd), rhodium (Rh), niobium (Nb), chromium (Cr), nickel (Ni), and alloys thereof, even more preferably selected from the group consisting of aluminum (Al), chromium (Cr), nickel (Ni) and alloys thereof, and still more preferably aluminum (Al). Preferably, the dielectric layers are independently made from one or more selected from the group consisting of metal fluorides such as magnesium fluoride ($MgF_2$), aluminum fluoride ($AlF_3$), cerium fluoride ($CeF_3$), lanthanum fluoride ($LaF_3$), sodium aluminum fluorides (e.g. $Na_3AlF_6$), neodymium fluoride ($NdF_3$), samarium fluoride ($SmF_3$), barium fluoride ($BaF_2$), calcium fluoride ($CaF_2$), lithium fluoride (LiF), and metal oxides such as silicium oxide (SiO), silicium dioxide ($SiO_2$), titanium oxide ($TiO_2$), aluminum oxide ($Al_2O_3$), more preferably selected from the group consisting of magnesium fluoride ($MgF_2$) and silicium dioxide ($SiO_2$) and still more preferably magnesium fluoride ($MgF_2$). Preferably, the absorber layers are independently made from one or more selected from the group consisting of aluminum (Al), silver (Ag), copper (Cu), palladium (Pd), platinum (Pt), titanium (Ti), vanadium (V), iron (Fe) tin (Sn), tungsten (W), molybdenum (Mo), rhodium (Rh), Niobium (Nb), chromium (Cr), nickel (Ni), metal oxides thereof, metal sulfides thereof, metal carbides thereof, and metal alloys thereof, more preferably selected from the group consisting of chromium (Cr), nickel (Ni), metal oxides thereof, and metal alloys thereof, and still more preferably selected from the group consisting of chromium (Cr), nickel (Ni), and metal alloys thereof. Preferably, the magnetic layer comprises nickel (Ni), iron (Fe) and/or cobalt (Co); and/or a magnetic alloy comprising nickel (Ni), iron (Fe) and/or cobalt (Co); and/or a magnetic oxide comprising nickel (Ni), iron (Fe) and/or cobalt (Co). When magnetic thin film interference pigment particles comprising a seven-layer Fabry-Perot structure are preferred, it is particularly preferred that the magnetic thin film interference pigment particles comprise a seven-layer Fabry-Perot absorber/dielectric/reflector/magnetic/reflector/dielectric/absorber multilayer structure consisting of a Cr/$MgF_2$/Al/Ni/Al/$MgF_2$/Cr multilayer structure.

The magnetic thin film interference pigment particles described herein may be multilayer pigment particles being considered as safe for human health and the environment and being based for example on five-layer Fabry-Perot multilayer structures, six-layer Fabry-Perot multilayer structures and seven-layer Fabry-Perot multilayer structures, wherein said pigment particles include one or more magnetic layers comprising a magnetic alloy having a substantially nickel-free composition including about 40 wt-% to about 90 wt-% iron, about 10 wt-% to about 50 wt-% chromium and about 0 wt-% to about 30 wt-% aluminum. Typical examples of multilayer pigment particles being considered as safe for human health and the environment can be found in EP 2 402 401 A1 which is hereby incorporated by reference in its entirety.

Magnetic thin film interference pigment particles described herein are typically manufactured by a conventional deposition technique of the different required layers onto a web. After deposition of the desired number of layers, e.g. by physical vapor deposition (PVD), chemical vapor deposition (CVD) or electrolytic deposition, the stack of layers is removed from the web, either by dissolving a release layer in a suitable solvent, or by stripping the material from the web. The so-obtained material is then broken down to flakes which have to be further processed by grinding, milling (such as for example jet milling processes) or any suitable method so as to obtain pigment particles of the required size. The resulting product consists of flat flakes with broken edges, irregular shapes and different aspect ratios. Further information on the preparation of suitable magnetic thin film interference pigment particles can be found e.g. in EP 1 710 756 A1 and EP 1 666 546 A1 which are hereby incorporated by reference.

Suitable magnetic cholesteric liquid crystal pigment particles exhibiting optically variable characteristics include without limitation magnetic monolayered cholesteric liquid crystal pigment particles and magnetic multilayered cholesteric liquid crystal pigment particles. Such pigment particles are disclosed for example in WO 2006/063926 A1, U.S. Pat. Nos. 6,582,781 and 6,531,221. WO 2006/063926 A1 discloses monolayers and pigment particles obtained therefrom with high brilliance and colorshifting properties with additional particular properties such as magnetizability. The disclosed monolayers and pigment particles, which are obtained therefrom by comminuting said monolayers, include a three-dimensionally crosslinked cholesteric liquid crystal mixture and magnetic nanoparticles. U.S. Pat. Nos. 6,582,781 and 6,410,130 disclose platelet-shaped cholesteric multilayer pigment particles which comprise the sequence $A^1/B/A^2$, wherein $A^1$ and $A^2$ may be identical or different and each comprises at least one cholesteric layer, and B is an interlayer absorbing all or some of the light transmitted by the layers $A^1$ and $A^2$ and imparting magnetic properties to said interlayer. U.S. Pat. No. 6,531,221 discloses platelet-shaped cholesteric multilayer pigment particles which comprise the sequence A/B and optionally C, wherein A and C are absorbing layers comprising pigment particles imparting magnetic properties, and B is a cholesteric layer.

Suitable interference coated pigments comprising one or more magnetic materials include without limitation structures consisting of a substrate selected from the group consisting of a core coated with one or more layers, wherein at least one of the core or the one or more layers have magnetic properties. For example, suitable interference coated pigments comprise a core made of a magnetic material such as those described hereabove, said core being coated with one or more layers made of one or more metal oxides, or they have a structure consisting of a core made of synthetic or natural micas, layered silicates (e.g. talc, kaolin and sericite), glasses (e.g. borosilicates), silicium dioxides ($SiO_2$), aluminum oxides ($Al_2O_3$), titanium oxides ($TiO_2$), graphites and mixtures of two or more thereof. Furthermore, one or more additional layers such as coloring layers may be present.

The magnetic or magnetizable pigment particles described herein may be surface treated so as to protect them against any deterioration that may occur in the coating composition and/or to facilitate their incorporation in the coating composition; typically corrosion inhibitor materials and/or wetting agents may be used.

Preferably, the coating composition described herein comprises the magnetic or magnetizable pigment particles described herein dispersed in the binder material. Preferably, the magnetic or magnetizable pigment particles are present in an amount from about 1 wt-% to about 40 wt-%, more preferably about 4 wt-% to about 30 wt-%, the weight percents being based on the total weight of the coating composition comprising the binder material, the magnetic or magnetizable pigment particles and other optional components of the coating composition.

The present invention further provides a process for producing the optical effect layer described herein on the substrate described herein, said process comprising the steps of a) applying, preferably with the printing unit described herein, the coating composition described herein on the substrate described herein, said coating composition being in a first state, b) exposing the coating composition in a first state to the magnetic field of the orientation means described herein thereby orienting at least a part of the magnetic or magnetizable pigment particles; and c) hardening by the hardening unit described herein the coating composition to a second state so as to fix the magnetic or magnetizable pigment particles in their adopted positions and orientations.

The applying step a) is preferably carried out by a printing process selected from the group consisting of screen printing, rotogravure printing, flexography printing and intaglio printing.

Screen printing (also referred in the art as silkscreen printing) is a stencil process whereby an ink is transferred to a surface through a stencil supported by a fine fabric mesh of silk, mono- or multi-filaments made of synthetic fibers such as for example polyam ides or polyesters or metal threads stretched tightly on a frame made for example of wood or a metal (e.g. aluminum or stainless steel). Alternatively, the screen-printing mesh may be a chemically etched, a laser-etched, or a galvanically formed porous metal foil, e.g. a stainless steel foil. The pores of the mesh are block-up in the non-image areas and left open in the image area, the image carrier being called the screen. Screen printing might be flat-bed or rotary. Screen printing is further described for example in *The Printing ink manual*, R. N. Leach and R. J. Pierce, Springer Edition, 5$^{th}$ Edition, pages 58-62 and in *Printing Technology*, J. M. Adams and P. A. Dolin, Delmar Thomson Learning, 5$^{th}$ Edition, pages 293-328.

Rotogravure (also referred in the art as gravure) is a printing process wherein the image elements are engraved into the surface of a cylinder. The non-image areas are at a constant original level. Prior to printing, the entire printing plate (non-printing and printing elements) is inked and flooded with ink. Ink is removed from the non-image by a wiper or a blade before printing, so that ink remains only in the cells. The image is transferred from the cells to the substrate by a pressure typically in the range of 2 to 4 bars and by the adhesive forces between the substrate and the ink. The term rotogravure does not encompass intaglio printing processes (also referred in the art as engraved steel die or copper plate printing processes) which rely for example on a different type of ink. More details are provided in "Handbook of print media", Helmut Kipphan, Springer Edition, page 48 and in *The Printing ink manual*, R. H. Leach and R. J. Pierce, Springer Edition, 5$^{th}$ Edition, pages 42-51.

Flexography preferably uses a unit with a doctor blade, preferably a chambered doctor blade, an anilox roller and plate cylinder. The anilox roller advantageously has small cells whose volume and/or density determines the ink application rate. The doctor blade lies against the anilox roller, and scraps off surplus ink at the same time. The anilox roller transfers the ink to the plate cylinder which finally transfers the ink to the substrate. Specific design might be achieved using a designed photopolymer plate. Plate cylinders can be made from polymeric or elastomeric materials. Polymers are mainly used as photopolymer in plates and sometimes as a seamless coating on a sleeve. Photopolymer plates are made from light-sensitive polymers that are hardened by ultraviolet (UV) light. Photopolymer plates are cut to the required size and placed in an UV light exposure unit. One side of the plate is completely exposed to UV light to harden or cure the base of the plate. The plate is then turned over, a negative of the job is mounted over the uncured side and the plate is further exposed to UV light. This hardens the plate in the image areas. The plate is then processed to remove the unhardened photopolymer from the nonimage areas, which lowers the plate surface in these nonimage areas. After processing, the plate is dried and given a post-exposure dose of UV light to cure the whole plate. Preparation of plate cylinders for flexography is described in *Printing Technology*, J. M. Adams and P. A. Dolin, Delmar Thomson Learning, 5$^{th}$ Edition, pages 359-360 and in *The Printing ink manual*, R. H. Leach and R. J. Pierce, Springer Edition, 5$^{th}$ Edition, pages 33-42.

Intaglio printing is referred in the art as engraved copper plate printing and engraved steel die printing. During intaglio printing processes, an engraved steel cylinder carrying a plate engraved with a pattern or image to be printed is supplied with ink of inking cylinder(s) (or chablon cylinder), each inking cylinder being inked in at least one corresponding color to form security features. Subsequent to the inking, any excess of ink on the surface of the intaglio printing plate is wiped off by a rotating wiping cylinder or by a paper wiping or tissue wiping ("calico"). The remaining ink in the engraving of the printing cylinder is transferred under pressure onto the substrate to be printed while the wiping cylinder is cleaned by a wiping solution. Subsequently to the wiping steps, the inked intaglio plate is brought into contact with the substrate and the ink is transferred under pressure from the engravings of the intaglio printing plate onto the substrate to be printed forming a thick printing pattern on the substrate. One of the distinguishing features of the intaglio printing process is that the film thickness of the ink transferred to the substrate can be varied from a few micrometers to several tens of micrometers by using correspondingly shallow or respectively deep recesses of the intaglio printing plate. Intaglio relief resulting from the intaglio ink layer thickness is emphasized by the embossing of the substrate, said embossing being produced by the pressure during the ink transfer. The tactility resulting from intaglio printing gives the banknotes their typical and recognizable touch feeling. In comparison with screen printing, rotogravure printing and flexography printing which require liquid inks, intaglio printing relies on greasy and pasty (highly viscous) inks, having a viscosity in the range of 5 to 40 Pa·s at 40° C. and 1000 $s^{-1}$. Intaglio printing is further described for example in *The Printing ink manual*, R. H. Leach and R. J. Pierce, Springer Edition, 5$^{th}$ Edition, page 74 and in *Optical Document Security*, R. L. van Renesse, 2005, 3$^{rd}$ Edition, pages 115-117.

The magnetic or magnetizable pigment particles comprised in the coating composition described herein are oriented by the use of the orienting device comprising the orientation means described herein for orienting them according to a desired orientation pattern. Thereby, a permanent magnetic pigment particle is oriented such that its magnetic axis is aligned with the direction of the external magnetic field line at the pigment particle's location. A magnetizable pigment particle without an intrinsic permanent magnetic field is oriented by the external magnetic field such that the direction of its longest dimension is aligned with a magnetic field line at the pigment particle's location. The above applies analogously in the event that the pigment particles should have a layer structure including a layer having magnetic or magnetizable properties. In this case, the longest axis of the magnetic layer or the longest axis of the magnetizable layer is aligned with the direction of the magnetic field.

While the coating composition comprising the magnetic or magnetizable pigment particles, described herein is in a not yet hardened state, i.e. while it is still wet or soft enough so that magnetic or magnetizable pigment particles therein can be moved and rotated (i.e. while the coating composition is in a first state), the coating composition is subjected to a magnetic field to achieve orientation of the particles. The step of magnetically orienting the magnetic or magnetizable pigment particles comprises a step of exposing the applied coating composition, while it is "wet" (i.e. still liquid and not too viscous, that is, in a first state), to a determined magnetic field generated by the orienting device described herein, thereby orienting the magnetic or magnetizable pigment particles along the field lines of the magnetic field such as to form an orientation pattern.

The process for producing the OEL described herein comprises a step of hardening (step c)) the coating composition to a second state so as to fix the magnetic or magnetizable particles in their adopted positions and orientations in a desired pattern to form the OEL, thereby transforming the coating composition to a second state. By this fixing, a solid coating or layer is formed. The hardening step may be performed by the processes described hereabove. The hardening step (step c)) can be performed either simultaneously with the step b) or subsequently to the step b). However, the time from the end of step b) to the beginning of step c) is preferably relatively short in order to avoid any de-orientation and loss of information. Typically, the time between the end of step b) and the beginning of step c) is less than 1 minute, preferably less than 20 seconds, further preferably less than 5 seconds. It is particularly preferable that there is essentially no time gap between the end of the orientation step b) and the beginning of the hardening step c), i.e. that step c) follows immediately after step b) or already starts while step b) is still in progress.

If desired, a primer layer may be applied to the substrate prior to the step a). This may enhance the quality of the OEL described herein or promote adhesion. Examples of such primer layers may be found in WO 2010/058026 A2.

The substrate described herein is preferably selected from the group consisting of papers or other fibrous materials, such as cellulose, paper-containing materials, glasses, metals, ceramics, plastics and polymers, metalized plastics or polymers, composite materials and mixtures or combinations thereof. Typical paper, paper-like or other fibrous materials are made from a variety of fibers including without limitation abaca, cotton, linen, wood pulp, and blends thereof. As is well known to those skilled in the art, cotton and cotton/linen blends are preferred for banknotes, while wood pulp is commonly used in non-banknote security documents. Typical examples of plastics and polymers include polyolefins such as polyethylene (PE) and polypropylene (PP), polyamides, polyesters such as poly(ethylene terephthalate) (PET), poly(1,4-butylene terephthalate) (PBT), poly(ethylene2,6-naphthoate) (PEN) and polyvinylchlorides (PVC). Spunbond olefin fibers such as those sold under the trademark Tyvek® may also be used as substrate. Typical examples of metalized plastics or polymers include the plastic or polymer materials described hereabove having a metal disposed continuously or discontinuously on their surface. Typical example of metals include without limitation aluminum (Al), chromium (Cr), copper (Cu), gold (Au), iron (Fe), nickel (Ni), silver (Ag), combinations thereof or alloys of two or more of the aforementioned metals. The metallization of the plastic or polymer materials described hereabove may be done by an electrodeposition process, a high-vacuum coating process or by a sputtering process. Typical examples of composite materials include without limitation multilayer structures or laminates of paper and at least one plastic or polymer material such as those described hereabove as well as plastic and/or polymer fibers incorporated in a paper-like or fibrous material such as those described hereabove. Of course, the substrate can comprise further additives that are known to the skilled person, such as sizing agents, whiteners, processing aids, reinforcing or wet strengthening agents, etc. The substrate described herein may be in the shape of a web (e.g. a continuous sheet of the materials described hereabove) or in the shape of sheets.

The OEL described herein may be provided directly on a substrate on which it shall remain permanently (such as for banknote applications). Alternatively, the OEL may also be provided on a temporary substrate for production purposes, from which the OEL is subsequently removed. This may for example facilitate the production of the OEL, particularly while the binder material is still in its fluid state. Thereafter, after hardening the coating composition for the production of the OEL, the temporary substrate may be removed from the OEL. Alternatively, the OEL described herein may also be provided on a temporary substrate for production of a transfer foil, which can be applied to a document or to an article in a separate transfer step. To this aim, the substrate is provided with a release coating, on which the one or more OELs are produced as described herein. When the OEL described herein is to be provided on a temporary substrate, the coating composition must be in a form that is physically integral after the hardening step, such as for instances in cases where a plastic-like or sheet-like material is formed by the hardening. Thereby, a film-like transparent and/or translucent material consisting of the OEL as such (i.e. essentially consisting of oriented magnetic or magnetizable pigment particles, hardened binder components for fixing the pigment particles in their orientation and forming a film-like material, such as a plastic film, and further optional components) can be provided.

Also described herein are processes for producing the OEL described herein on the substrate described herein and further comprising one or more adhesive layers. Said one or more adhesive layers may be applied over the substrate comprising the OEL described herein. Preferably, the one or more adhesive layers may be applied to substrate comprising the OEL after the hardening step has been completed. In such instances, an adhesive label comprising the one or more adhesive layers, the OEL and the substrate is formed. Such a label may be attached to all kinds of documents or other articles or items without printing or other processes involving machinery and rather high effort.

According to one embodiment of the present invention, the substrate described herein comprises more than one OEL on the substrate described herein, for example it may comprise two, three, etc. OELs. The substrate may comprise a first OEL and a second OEL, wherein both of them are present on the same side of the substrate or wherein one is present on one side of the substrate and the other one is present on the other side of the substrate. If provided on the same side of the substrate, the first and the second OEL may be adjacent or not adjacent to each other. Additionally or alternatively, one of the OEL may partially or fully superimpose the other OEL. The magnetic orientation of the magnetic or magnetizable pigment particles for producing the first OEL and the magnetic or magnetizable pigment particles for producing the second OEL may be performed simultaneously or sequentially, with or without intermediate hardening or partial hardening of the binder material.

The OEL described herein may be used for decorative purposes as well as for protecting and authenticating a security document. The present invention also encompasses articles and decorative objects comprising the OEL described herein. The articles and decorative objects may comprise more than one optical effect layers described herein. Typical examples of articles and decorative objects include without limitation luxury goods, cosmetic packaging, automotive parts, electronic/electrical appliances, furniture, etc.

An important aspect of the present invention relates to security documents comprising the OEL described herein. The security document may comprise more than one OELs described herein.

Security documents include without limitation value documents and value commercial goods. Typical example of value documents include without limitation banknotes, deeds, tickets, checks, vouchers, fiscal stamps and tax labels, agreements and the like, identity documents such as passports, identity cards, visas, driving licenses, bank cards, credit cards, transactions cards, access documents or cards, entrance tickets, public transportation tickets or titles and the like, preferably banknotes, identity documents, right-conferring documents, driving licenses and credit cards. The term "value commercial good" refers to packaging materials, in particular cosmetic articles, nutraceutical articles, pharmaceutical articles, alcohols, beverages or foodstuffs, electrical/electronics articles, fabrics or jewelry, i.e. articles that shall be protected against counterfeiting and/or illegal reproduction in order to warrant the content of the packaging like for instance genuine drugs. Examples of these packaging materials include without limitation labels, such as authentication brand labels, tamper evidence labels and seals. It is pointed out that the disclosed substrates, value documents and value commercial goods are given exclusively for exemplifying purposes, without restricting the scope of the invention. With the aim of further increasing the security level and the resistance against counterfeiting and illegal reproduction of security documents, the substrate may comprise printed, coated, or laser-marked or laser-perforated indicia, watermarks, security threads, fibers, planchettes, luminescent compounds, windows, foils, decals and combinations thereof. With the same aim of further increasing the security level and the resistance against counterfeiting and illegal reproduction of security documents, the substrate may comprise one or more marker substances or taggants and/or machine readable substances (e.g. luminescent substances, UV/visible/IR absorbing substances, magnetic substances and combinations thereof).

Alternatively, the OEL may be produced onto an auxiliary substrate such as for example a security thread, security stripe, a foil, a decal, a window or a label and consequently transferred to a security document in a separate step.

The skilled person can envisage several modifications to the specific embodiments described above without departing from the spirit of the present invention. Such modifications are encompasses by the present invention.

Further, all documents referred to throughout this specification are hereby incorporated by reference in their entirety as set forth in full herein.

The invention claimed is:

1. A printing device for producing an optical effect layer on a substrate, the printing device comprising:

a) an orienting device for orienting magnetic or magnetizable pigment particles in a coating composition on the substrate, the orienting device comprising an orientation means, said orientation means being either a magnetic field generating belt or a non-magnetic belt comprising magnetic field generating elements encased within the non-magnetic belt, said belt being driven by at least two rollers; and b) a hardening unit.

2. The printing device according to claim 1, further comprising a printing unit arranged to apply a coating composition comprising the magnetic or magnetizable pigment particles in a fluid binder on the substrate.

3. The printing device according to claim 2, wherein the printing unit is a screen printing unit, a rotogravure printing unit, a flexography printing unit or an intaglio printing unit.

4. The printing device according to claim 1, wherein the hardening unit comprises one or more radiation sources and/or one or more heaters.

5. The printing device according to claim 1, wherein the hardening unit is arranged so as to harden the coating composition on the substrate while the substrate is in contact with or otherwise disposed on the orientation means.

6. The printing device of claim 1, wherein the belt is formed into a loop comprising first and second straight sections each extending between rollers, the printing device being arranged so that the substrate is disposed on at least one of the first and second straight sections while a magnetic field generated by the belt orients the magnetic or magnetizable pigment particles for creating an optical effect layer.

7. A process for producing an optical effect layer on a substrate utilizing the printing device recited in claim 1, said process comprising the steps of:

a) applying a coating composition comprising magnetic or magnetizable pigment particles and a fluid binder on the substrate, said coating composition being in a first state;

b) exposing the coating composition in the first state to the magnetic field of the orientation means of the printing device, thereby orienting at least a part of the magnetic or magnetizable pigment particles; and c) hardening by the hardening unit of the printing device the coating composition to a second state so as to fix the magnetic or magnetizable pigment particles in their adopted positions and orientations.

8. The process according to claim 7, wherein at least a part of the magnetic or magnetizable pigment particles is constituted by optically variable magnetic or magnetizable pigment particles.

9. The process according to claim 7, wherein the hardening step is carried out by applying heat and/or radiation.

10. The process according to claim 7, wherein the hardening step c) is carried out partially simultaneously or simultaneously with step b).

11. The process according to claim 7, wherein the substrate is selected from the group consisting of papers or other fibrous materials, paper-containing materials, glasses, metals, ceramics, plastics and polymers, metalized plastics or polymers, composite materials and mixtures or combinations thereof.

12. An optical effect layer prepared by the process recited in claim 7.

13. A security document comprising one or more optical effect layer recited in claim 12.

14. The printing device of claim 6, wherein the loop is elongate and is comprised of first and second 180° turns defined by rollers at opposed longitudinal ends of the elongate loop and first and second straight sections extending between the opposed turns, one of the straight sections being disposed adjacent the substrate.

15. The process for producing an optical effect layer on a substrate as recited in claim 7, wherein in step a), the applying of the coating composition is performed using a print unit of the printing device.

16. The process according to claim 8, wherein the optically variable magnetic or magnetizable pigment particles are selected from the group consisting of magnetic thin-film interference pigment particles, magnetic cholesteric liquid crystal pigment particles, interference coated pigment particles comprising a magnetic material and mixtures of two or more thereof.

* * * * *